US008376305B2

(12) United States Patent
Riemenschneider et al.

(10) Patent No.: US 8,376,305 B2
(45) Date of Patent: Feb. 19, 2013

(54) STABILITY OF SLIDABLY ADJUSTABLE BOAT ACCESSORY

(75) Inventors: Robert A. Riemenschneider, Oakdale, MN (US); Richard J. Garelick, Minneapolis, MN (US); Todd W. Moore, Rosemount, MN (US)

(73) Assignee: Garelick Mfg. Co., St. Paul Park, MN (US)

( * ) Notice: Subject to any disclaimer, the term of this patent is extended or adjusted under 35 U.S.C. 154(b) by 15 days.

(21) Appl. No.: 13/134,653

(22) Filed: Jun. 14, 2011

(65) Prior Publication Data

US 2012/0318947 A1 Dec. 20, 2012

(51) Int. Cl.
*F16M 13/00* (2006.01)

(52) U.S. Cl. ..... 248/423; 248/424

(58) Field of Classification Search ..... 248/178.1, 248/188.1, 219.2, 298.1, 416, 423, 424; 108/137, 108/143, 150; 297/115, 344.1, 344.11, 344.13, 297/411.35, 411.37, 451.5
See application file for complete search history.

(56) References Cited

U.S. PATENT DOCUMENTS 5,082,328 A * 1/1992 Garelick ..... 297/344.1
5,374,102 A * 12/1994 Archambault et al. .. 297/344.13
5,882,076 A * 3/1999 Garelick et al. ..... 297/344.18
5,884,887 A * 3/1999 Garelick et al. ..... 248/423
6,079,786 A * 6/2000 Kirkland et al. ..... 297/344.24
6,325,456 B1 * 12/2001 Carnahan ..... 297/344.24
7,303,236 B2 * 12/2007 Ritter et al. ..... 297/344.11
7,490,905 B2 * 2/2009 Ritter et al. ..... 297/344.11
7,938,377 B2 * 5/2011 Draghici et al. ..... 248/429

* cited by examiner

*Primary Examiner* — Gwendolyn Baxter
(74) *Attorney, Agent, or Firm* — Jacobson and Johnson LLC

(57) ABSTRACT

A mechanism for stabilizing a slidably adjustable boat accessory such as a boat seat or table including a first rigid plate member adapted for attachment to the underside of a boat accessory, a second rigid plate member adapted for attachment to a support surface with the first plate member having two elongate opposite side edges curved underside forming parallel tracks and the second plate member having two elongate opposite side edges slidably engaging corresponding respective tracks of the first plate member for slidably moving the first plate member along the tracks for slidably adjusting the location of an attached boat accessory with at least one of the opposing side edges of the second plate member beveled at least in part, a wedge shaped member engaged with the second plate member resting in part on the bevel, while adjustably moving the wedge shaped member along the bevel such that the wedge shaped member is moved laterally in its associated track.

6 Claims, 5 Drawing Sheets

STABILITY OF SLIDABLY ADJUSTABLE BOAT ACCESSORY

FIELD OF THE INVENTION

This invention relates to user friendly boat accessories such as boat seats and tables and the like that are mounted onto the boat, usually onto the boat deck by a post or pedestal, and are slidably adjustable by the user. More specifically the invention is aimed at providing stability by eliminating or at least minimizing any side-to-side and/or front-to-back wobble, which otherwise might occur when the accessory is being slidably adjusted and while it is being used.

BACKGROUND OF THE INVENTION

Some early slidably adjustable boat seats which typically were mounted on a pedestal secured or anchored to the boat deck utilized a pair of slidably engaged plates for adjusting the fore and aft or front and back location of a boat accessory mounted on one of the plates and a manually operable handle was used to apply pressure to bring the plates into tight frictional engagement to lock the seat at its desired location. U.S. Pat. No. 5,884,887 provides an improved more positive locking arrangement. The '887 patent describes in some detail the manner in which the plates are slidably engaged with one another for adjusting the location of the pedestal mounted boat seat and for that limited purpose is incorporated herein by reference. The '887 patent utilizes spaced recesses on one of the plates for selective engagement with teeth on a rotatable rod attached to the other plate to firmly lock the plate on which the seat is mounted at its desired location.

Although the fore and aft adjustment mechanism for a slidably adjustable boat accessory as described in the '887 patent has resulted in the user, e.g. one sitting on a boat seat, firmly locked in the fore or aft location, at times a side-to-side and/or front to back wobble may occur. This may happen while the user is adjusting the front-to-back location or may occur even though the seat is firmly locked in its fore or aft position. For example, the boat usually rocks while it is moving though the water, even at a low or moderate speed, which may cause the boat seat to rock or wobble sideways or front to back. It has been discovered that this can happen for a number of reasons, e.g. wear on the slide and locking members, accumulation of tolerances during manufacturing, temperature and weather variations, etc.

BRIEF SUMMARY OF THE INVENTION

The present invention provides a field adjustment to stabilize a slidably adjustable boat accessory by eliminating or at least minimizing rocking or wobbling the accessory.

Similar to earlier devices described hereinabove a pair of rigid plate members are slidably engaged with one another by one of the members having curved opposite side edges forming a pair of tracks and the other member having its opposite side edges slidably engaged in those tracks. A boat accessory, such as a boat seat, is attached to one of the rigid plate members and the other plate member is adapted for attachment to a support surface for supporting the boat seat onto the boat deck. At least one side edge of the plate member engaged in the track of the other member is tapered or beveled at least in part and a wedge of suitable material is coupled to the same plate edge with a section of the wedge having a taper resting on the tapered or beveled portion of the rigid member. Manually adjustable threaded members on the plate member in contact with the wedge are operated as necessary to move the wedge along the side of the plate member thereby causing the wedge to move laterally with respect to the edge of the plate member so that the slidable member is snugly engaged in its associated track to prevent the attached boat seat from wobbling or rocking which otherwise might occur, especially when occupied. It may be desirable to have beveled edges with corresponding attached wedges and adjustable threaded members on both opposite side edges of the plate member. Also, a manually rotatable rod with spaced teeth in combination with a set of recesses or the like on the plate member provides a positive locking of the boat seat in the desired front or back location.

DESCRIPTION OF THE PREFERRED EMBODIMENT

Figure 1:
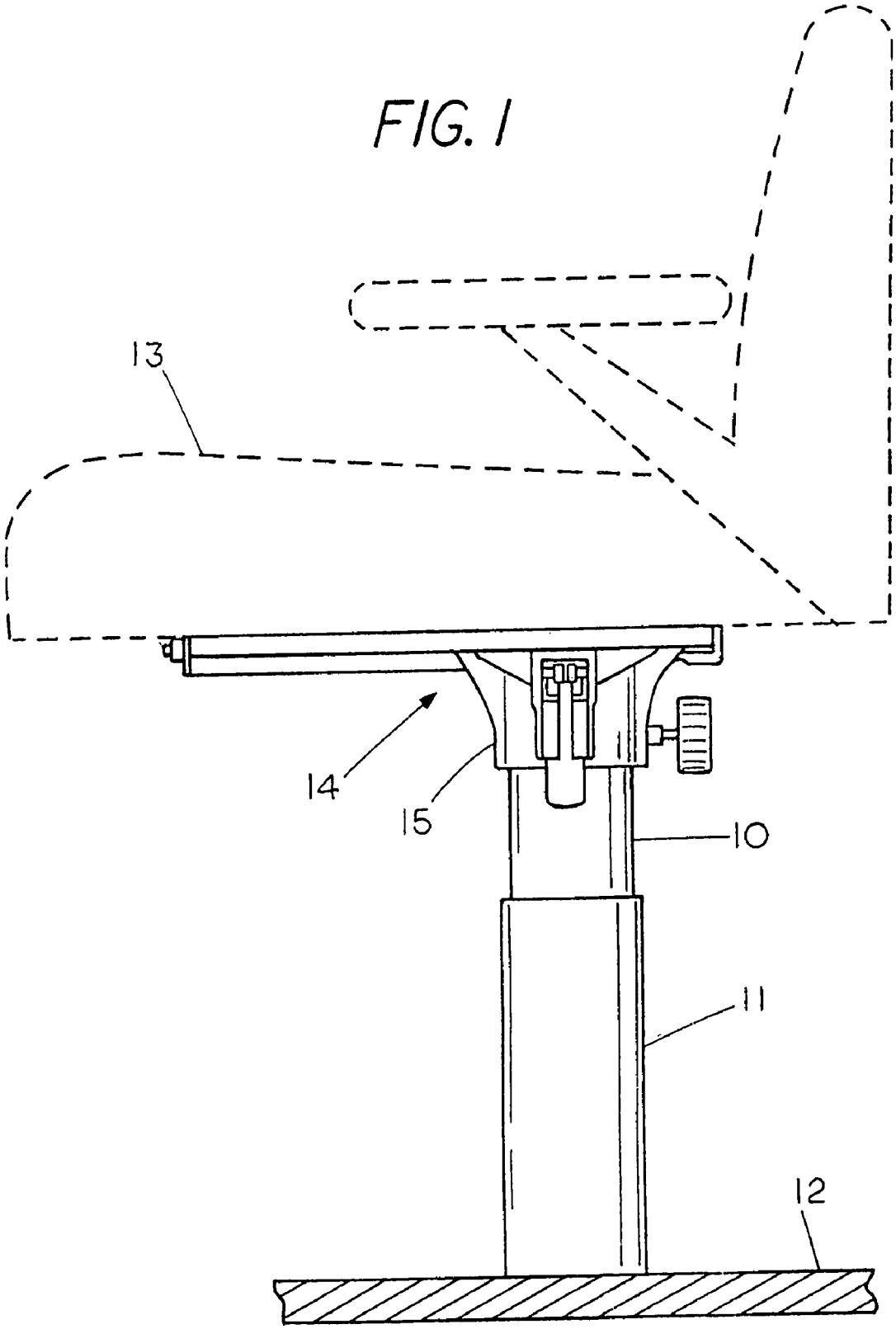
FIG. 1 is a side view of an elevated boat seat utilizing the instant invention.

FIG. 1 is a side view of an elevated boat seat 13 (in phantom) utilizing the mechanism of the instant invention. Conventionally, usually a rigid support post or column 10 extends vertically upward from a tubular supporting pillar or pedestal 11, which is attached at its base in some convenient fashion to the boat deck 12. Conventionally pillar 11 contains a suitable mechanism for adjusting the height of column 10 to permit a height adjustment of the boat seat 13. Sometimes the slidably adjustable boat seat maybe at a fixed elevation.

A spider or yoke identified generally by reference numeral 14 has a downward projecting annular section 15 which is coupled to support post 10 and has an integrally cast horizontal plate member 16 which has two elongate opposite side edges 16*a* and 16*b* slidably engaging corresponding respective tracks 17*a* and 17*b* of a first plate member 17 for slidably moving the first plate member along the tracks of the first plate member 17 for slidably adjusting the front or back location of an attached boat accessory.

Openings 18 in plate member 17 (see FIG. 5) are provided for fasteners to attach to the underside of various boat accessories such as boat seat 13 to secure it in place on plate 17. Plate member 17 with seat 13 attached can be slidably moved with respect to plate member 16 to adjust the forward and/or backward (fore and aft) position of the seat and then releasably locked in place with a conveniently accessible handle member 19.

Figure 2:
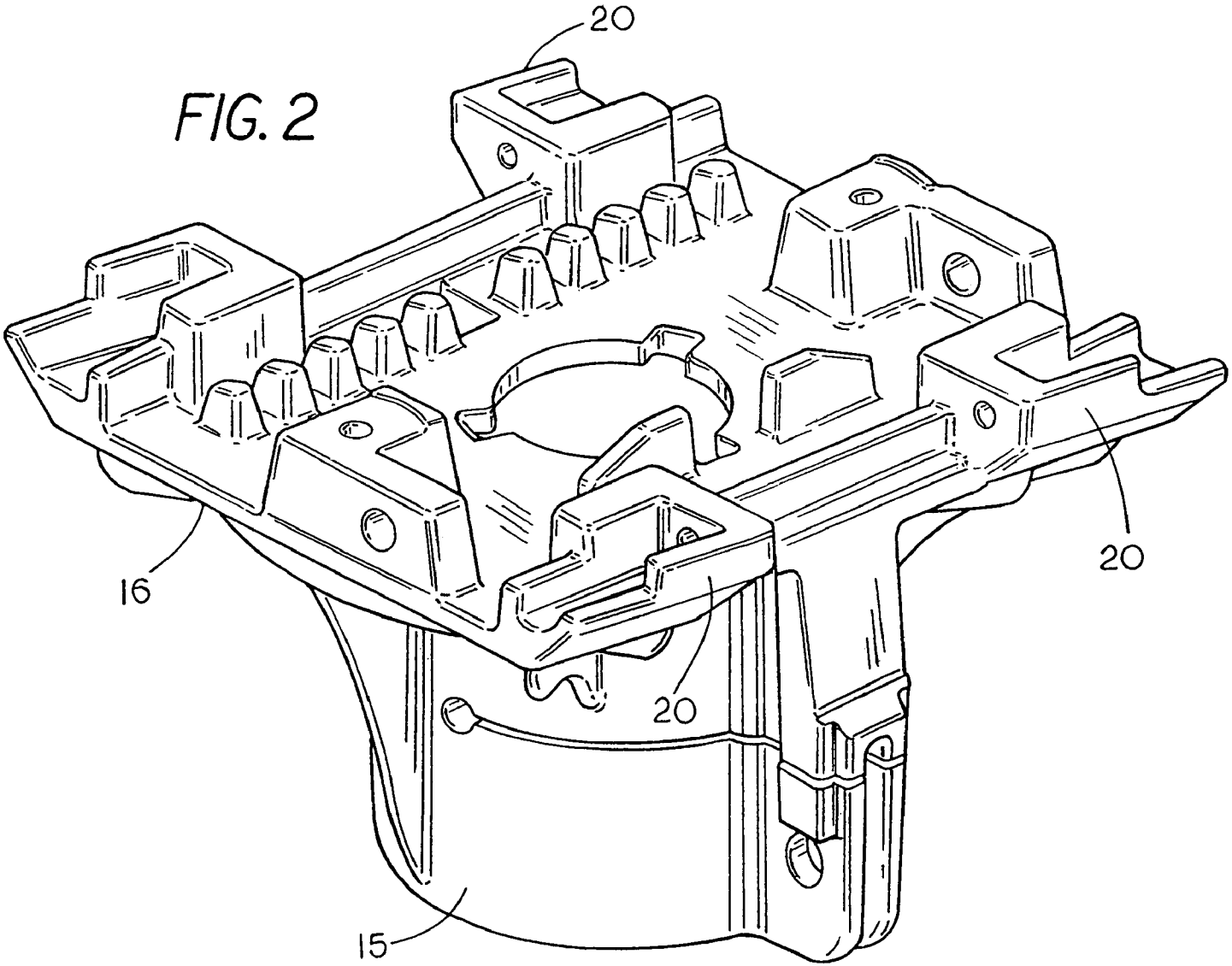
FIG. 2 is a perspective view of a supporting spider or yoke.
Figure 3:
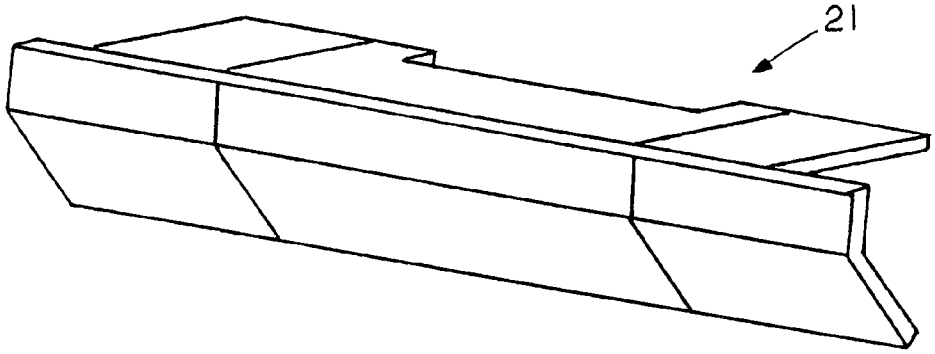
FIG. 3 is a perspective front view of a wedge shaped member for resting in part on a bevel of the yoke.
Figure 4:
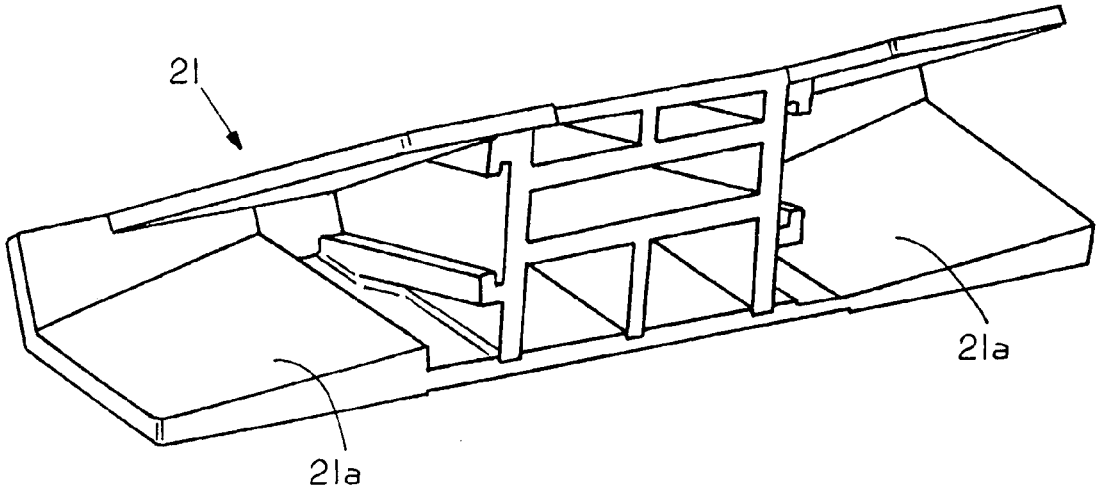
FIG. 4 is a perspective rear view of the wedge shaped member of FIG. 3.
Figure 5:
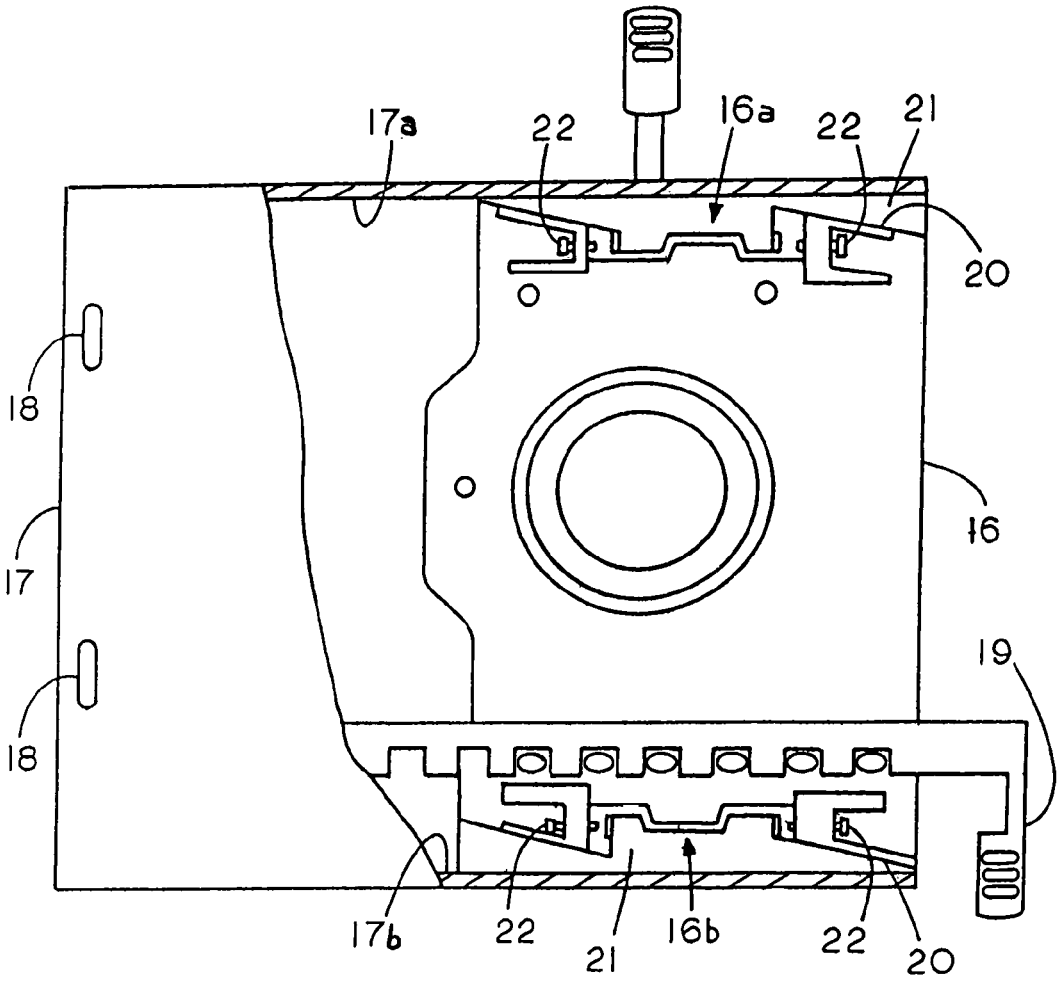
FIG. 5 is top view of an assembly for stabilizing a slidably adjustable boat accessory.
Figure 6:
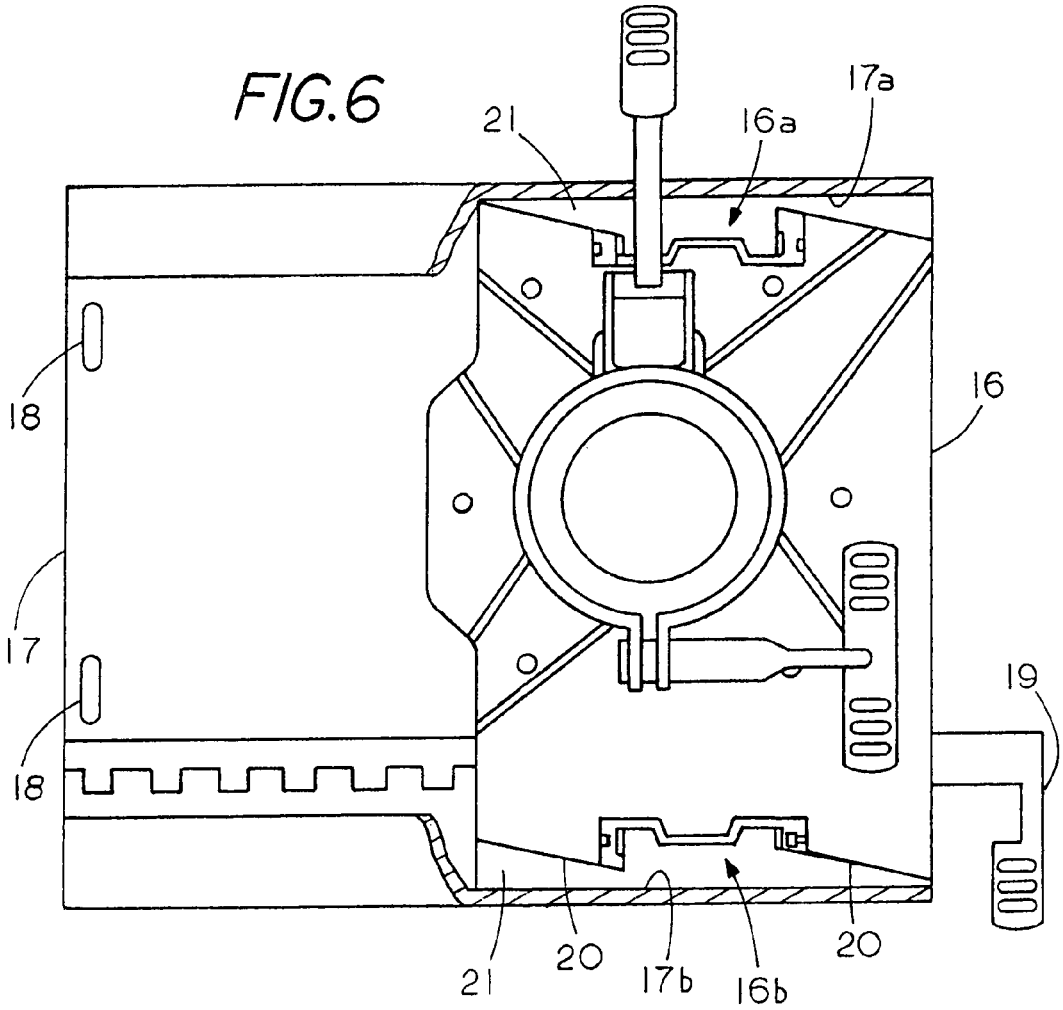
FIG. 6 is a bottom view of the assembly of FIG. 5.
Figure 7:
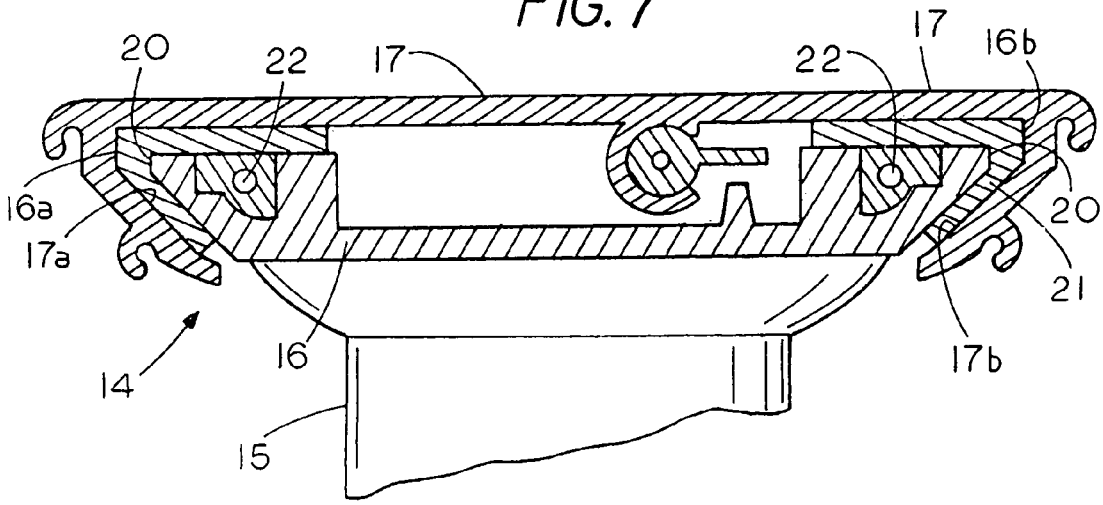
FIG. 7 is a cross sectional view of the assembly of FIGS. 5 and 6.

Referring to FIGS. 2, 5 and 6, a feature of the present invention is that at least one of the opposing side edges 16*a* and 16*b* of plate member 16 is tapered or beveled at 20 at least in part and a wedge shaped member 21, shown in FIGS. 3 and 4, of suitable material such as but not limited to metal, rubber, polymer plastics or the like engages the second plate member 16 and rests in part on the bevel 20.

Although the wedge shaped member may comprise as few as one tapered surface that rests in part on bevel 20, the embodiment of FIG. 4 shows wedge shaped member 21 having a pair of tapered surfaces 21*a* for engaging a pair of bevels 20 located on each of the side edges 16*a* and 16*b* of plate member 16. The bevels 20 is preferably angled to move the wedge shaped member 21 into snug engagement with the associated track 17*a* and 17*b*.

The present invention also includes weans for adjustably moving the wedge shaped member 21 along the bevel 20 such that the wedge shaped member 21 is moved laterally in its associated track 17*a* and 17*b* to reduce and/or eliminate the presence of any gaps between the wedge shaped member 21 and its associated track 17*a* and 17*b*. As shown in FIG. 5, the means for adjustably moving the wedge shaped member 21 along the bevel 20 may comprise manually adjustable threaded members 22 that are located on plate member 16 and are in contact with the wedge shaped member 21. The manually adjustable threaded members 22 may be operated by such tools as a traditional screw driver as necessary to move the wedge shaped member 21 along the side of plate member 16 thereby causing the wedge 21 to move laterally with respect to the edge of plate member 16 so that the slidable member is snugly engaged in its associated tracks 17*a* and 17*b* to prevent the attached boat seat 13 from wobbling or rocking, especially when occupied.

Although alternative embodiments may comprise one of the opposing side edges 16*a* and 16*b* of plate member 16 being beveled 20 at least in part with a corresponding wedge shaped member 21 engaging thereto, it may be desirable to have beveled edges 20 with corresponding attached wedges 21 and adjustable threaded members 22 on both opposite side edges 16*a* and 16*b* of the plate member 16 as shown in the embodiments of FIGS. 5 and 6.

The present invention also provides a method for producing a stable transition for a user when slidably adjusting the location of a boat accessory, such as a boat seat or table, mounted on a slide mechanism which comprises a first rigid plate member 17 adapted for attachment to the underside of a boat accessory and having two elongate opposite side edges curved underside forming parallel tracks 17*a* and 17*b* and a second rigid plate member 16 having two elongate side edges 16*a* and 16*b* slidably engaged with corresponding respective tracks 17*a* and 17*b* of the first plate member 17 for slidably adjusting the location of an attached boat accessory by initially forming a bevel 20 on one of the edges 16*a* and 16*b* of the second plate member 16 then, coupling a wedge member 21 onto the second plate member 16 so that the wedge member 21 rests at least in part on the bevel 21 and finally adjustably moving the wedge member 21 along the beveled edge 20 when the second plate member edge 16*a* and 16*b* is engaged in its associated track 17*a* and 17*b* to cause the wedge member 21 to move laterally into snug engagement with the associated track 17*a* and 17*b*.

We claim:

1. A mechanism for stabilizing a slidably adjustable boat accessory, comprising:

a) a first rigid plate member adapted for attachment to the underside of a boat accessory;

b) a second rigid plate member adapted for attachment to a support surface;

c) said first plate member having two elongate opposite side edges curved underside forming parallel tracks;

d) said second plate member having two elongate opposite side edges slidably engaging corresponding respective tracks of said first plate member for slidably moving said first plate member along said tracks for slidably adjusting the location of an attached boat accessory;

e) at least one of said opposing side edges of said second plate member beveled at least in part;

f) a wedge shaped member engaged to said second plate member resting in part on said bevel; and g) means for adjustably moving said wedge shaped member along said bevel such that said wedge shaped member is moved laterally in its associated track.

2. The invention as described in claim 1 wherein said means for adjusting said wedge shaped member, comprises:

manually adjustable members on said second plate member threadably engaging said wedge shaped member for moving said wedge shaped member along said bevel.

3. The invention as described in claim 2, wherein the bevel on said second plate member is angled to move said wedge shaped member into snug engagement with the associated track.

4. For a slidably adjustable boat accessory having a first rigid plate member adapted for attachment to the underside of a boat accessory and having two elongate opposite side edges curved underside forming parallel tracks and a second rigid plate member having two elongate opposite side edges slidably engaging corresponding respective tracks on said first rigid member for slidably moving said first plate member along said tracks for slidably adjusting the location of an attached boat accessory, the improvement comprising:

a) an edge of said second plate member beveled, at least in part;

b) a wedge-shaped member coupled to said second plate member and resting in part on said beveled edge; and c) manually adjustable threaded members on said second plate member threadably engaging said wedge-shaped member for adjustably moving said wedge-shaped member along said beveled edge to move said wedge-shaped member laterally in it associated track.

5. The invention as described in claim 4 wherein the bevel on said second member edge is tapered at an angle to move said wedge-shaped member into snug engagement with the associated track.

6. A method for providing a stable transition for a user when slidably adjusting the location of a boat accessory, mounted on a slide mechanism which comprises a first rigid plate member adapted for attachment to the underside of a boat accessory and having two elongate opposite side edges curved underside forming parallel tracks and a second rigid plate member having two elongate side edges slidably engaged with corresponding respective tracks of said first plate member for slidably adjusting the location of an attached boat accessory, said method comprising the steps of:

a) first forming a bevel on one of said edges of the second plate member; then, b) coupling a wedge member onto said second plate member so that the wedge member rests at least in part on said bevel; then, c) adjustably moving the wedge member along the beveled edge when the second plate member edge is engaged in its associated track to cause the wedge member to move laterally into snug engagement with the associated track.

* * * * *